US012303033B2

(12) United States Patent
Hill et al.

(10) Patent No.: US 12,303,033 B2
(45) Date of Patent: May 20, 2025

(54) HEADBOARD WITH BACK LIGHT STRIP

(71) Applicant: Sleep Number Corporation, Minneapolis, MN (US)

(72) Inventors: Carli Hill, Oxnard, CA (US); Joseph Ermalovich, Santa Barbara, CA (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

(21) Appl. No.: 18/734,072

(22) Filed: Jun. 5, 2024

(65) Prior Publication Data

US 2024/0315461 A1 Sep. 26, 2024

Related U.S. Application Data

(63) Continuation of application No. 18/086,104, filed on Dec. 21, 2022, now Pat. No. 12,029,322.

(60) Provisional application No. 63/295,221, filed on Dec. 30, 2021.

(51) Int. Cl.
*A47C 21/00* (2006.01)
*A47C 31/00* (2006.01)

(52) U.S. Cl.
CPC ..... *A47C 21/003* (2013.01); *A47C 31/008* (2013.01)

(58) Field of Classification Search
CPC .... A47C 21/003; A47C 31/008; A47C 19/022
See application file for complete search history.

(56) References Cited

U.S. PATENT DOCUMENTS 8,444,558 B2 5/2013 Young et al.
8,672,853 B2 3/2014 Young
8,984,687 B2 3/2015 Stusynski et al.
9,370,457 B2 6/2016 Nunn et al.
9,392,879 B2 7/2016 Nunn et al.
9,445,751 B2 9/2016 Young et al.
(Continued)

FOREIGN PATENT DOCUMENTS

JP H0664557 9/1994
JP H114730 1/1999
(Continued)

OTHER PUBLICATIONS

U.S. Appl. No. 16/719,177, Nunn et al., filed Dec. 18, 2019.
(Continued)

*Primary Examiner* — Elmito Breval
(74) *Attorney, Agent, or Firm* — Fish & Richardson P.C.

(57) ABSTRACT

Described are bed systems having a headboard, backward facing lights positioned at a back side of the headboard, and a controller operably connected to the backward facing lights that can drive the backward facing lights to provide circadian lighting. The backward facing lights can be recessed into the back side of the headboard. The backward facing lights can provide ambient lighting when controlled by the controller. The controller can determine when a user of the bed system is waking up and control the backward facing lights to provide circadian lighting that corresponds to a wakeup routine for the user. The controller can also determine when the user is going to sleep and control the backward facing lights to provide circadian lighting that corresponds to a sleep routine for the user. The backward facing lights can be LED strips positioned inside an extruded channel in the back side of the headboard.

20 Claims, 6 Drawing Sheets

(56) References Cited

U.S. PATENT DOCUMENTS

| | | | |
|---|---|---|---|
| 9,504,416 | B2 | 11/2016 | Young et al. |
| 9,510,688 | B2 | 12/2016 | Nunn et al. |
| 9,635,953 | B2 | 5/2017 | Nunn et al. |
| 9,770,114 | B2 | 9/2017 | Brosnan et al. |
| 9,844,275 | B2 | 12/2017 | Nunn et al. |
| 9,854,919 | B1 | 1/2018 | Risdon |
| 9,931,085 | B2 | 4/2018 | Young et al. |
| 9,970,651 | B2 | 5/2018 | Wang et al. |
| 10,058,467 | B2 | 8/2018 | Stusynski et al. |
| 10,092,242 | B2 | 10/2018 | Nunn et al. |
| 10,149,549 | B2 | 12/2018 | Erko et al. |
| 10,182,661 | B2 | 1/2019 | Nunn et al. |
| 10,201,234 | B2 | 2/2019 | Nunn et al. |
| 10,251,490 | B2 | 4/2019 | Nunn et al. |
| 10,314,407 | B1 | 6/2019 | Main et al. |
| 10,342,358 | B1 | 7/2019 | Palashewski et al. |
| 10,441,086 | B2 | 10/2019 | Nunn et al. |
| 10,441,087 | B2 | 10/2019 | Karschnik et al. |
| 10,448,749 | B2 | 10/2019 | Palashewski et al. |
| 10,492,969 | B2 | 12/2019 | Stusynski et al. |
| 10,632,032 | B1 | 4/2020 | Stusynski et al. |
| 10,646,050 | B2 | 5/2020 | Nunn et al. |
| 10,674,832 | B2 | 6/2020 | Brosnan et al. |
| 10,716,512 | B2 | 7/2020 | Erko et al. |
| 10,729,255 | B2 | 8/2020 | Erko et al. |
| 10,736,432 | B2 | 8/2020 | Brosnan et al. |
| 10,750,875 | B2 | 8/2020 | Palashewski et al. |
| 10,827,846 | B2 | 11/2020 | Karschnik et al. |
| 10,881,219 | B2 | 1/2021 | Nunn et al. |
| 10,957,335 | B2 | 3/2021 | Demirli et al. |
| 10,959,535 | B2 | 3/2021 | Karschnik et al. |
| D916,745 | S | 4/2021 | Stusynski et al. |
| 10,980,351 | B2 | 4/2021 | Nunn et al. |
| 11,096,849 | B2 | 8/2021 | Stusynski et al. |
| 11,122,909 | B2 | 9/2021 | Palashewski et al. |
| 11,160,683 | B2 | 11/2021 | Nunn et al. |
| 11,206,929 | B2 | 12/2021 | Palashewski et al. |
| D954,725 | S | 6/2022 | Stusynski et al. |
| D968,436 | S | 11/2022 | Stusynski et al. |
| D975,121 | S | 1/2023 | Stusynski et al. |
| D1,000,464 | S | 10/2023 | Stusynski et al. |
| D1,018,476 | S | 3/2024 | Dixon et al. |
| 2008/0077020 | A1 | 3/2008 | Young et al. |
| 2008/0101058 | A1 | 5/2008 | Smith |
| 2010/0170043 | A1 | 7/2010 | Young et al. |
| 2011/0144455 | A1 | 6/2011 | Young et al. |
| 2014/0277822 | A1 | 9/2014 | Nunn et al. |
| 2016/0015184 | A1 | 1/2016 | Nunn et al. |
| 2016/0367039 | A1 | 12/2016 | Young et al. |
| 2017/0065220 | A1 | 3/2017 | Young et al. |
| 2017/0128001 | A1 | 5/2017 | Torre et al. |
| 2017/0143269 | A1 | 5/2017 | Young et al. |
| 2019/0053761 | A1 | 2/2019 | Torre et al. |
| 2019/0069840 | A1 | 3/2019 | Young et al. |
| 2019/0200777 | A1 | 7/2019 | Demirli et al. |
| 2019/0201265 | A1 | 7/2019 | Sayadi et al. |
| 2019/0201266 | A1 | 7/2019 | Sayadi et al. |
| 2019/0201267 | A1 | 7/2019 | Demirli et al. |
| 2019/0201268 | A1 | 7/2019 | Sayadi et al. |
| 2019/0201270 | A1 | 7/2019 | Sayadi et al. |
| 2019/0201271 | A1 | 7/2019 | Grey et al. |
| 2019/0328146 | A1 | 10/2019 | Palashewski et al. |
| 2019/0328147 | A1 | 10/2019 | Palashewski et al. |
| 2020/0315367 | A1 | 10/2020 | Demirli et al. |
| 2020/0336010 | A1 | 10/2020 | Holmvik et al. |
| 2020/0337470 | A1 | 10/2020 | Sayadi et al. |
| 2020/0359807 | A1 | 11/2020 | Brosnan et al. |
| 2020/0367663 | A1 | 11/2020 | Nunn et al. |
| 2020/0405070 | A1 | 12/2020 | Palashewski et al. |
| 2020/0405240 | A1 | 12/2020 | Palashewski et al. |
| 2021/0000261 | A1 | 1/2021 | Erko et al. |
| 2021/0034989 | A1 | 2/2021 | Palashewski et al. |
| 2021/0045541 | A1 | 2/2021 | Nunn et al. |
| 2021/0068552 | A1 | 3/2021 | Palashewski et al. |
| 2021/0112992 | A1 | 4/2021 | Nunn et al. |
| 2021/0267380 | A1 | 9/2021 | Stusynski |
| 2021/0282570 | A1 | 9/2021 | Karschnik et al. |
| 2021/0289947 | A1 | 9/2021 | Karschnik et al. |
| 2021/0314405 | A1 | 10/2021 | Demirli et al. |
| 2021/0346218 | A1 | 11/2021 | Stusynski et al. |
| 2021/0378408 | A1 | 12/2021 | Chen |
| 2022/0000273 | A1 | 1/2022 | Palashewski et al. |
| 2022/0000654 | A1 | 1/2022 | Nunn et al. |
| 2022/0225786 | A1 | 7/2022 | Palashewski et al. |
| 2022/0265059 | A1 | 8/2022 | Palashewski et al. |
| 2022/0305231 | A1 | 9/2022 | Stusynski et al. |
| 2022/0346565 | A1 | 11/2022 | Karschnik et al. |
| 2022/0354431 | A1 | 11/2022 | Molina et al. |
| 2022/0386947 | A1 | 12/2022 | Molina et al. |
| 2022/0395233 | A1 | 12/2022 | Siyahjani et al. |
| 2023/0018558 | A1 | 1/2023 | Demirli et al. |
| 2023/0035257 | A1 | 2/2023 | Karschnik et al. |
| 2023/0037482 | A1 | 2/2023 | Demirli et al. |
| 2023/0054736 | A1 | 2/2023 | Holmvik et al. |
| 2023/0063373 | A1 | 3/2023 | Young et al. |
| 2023/0142604 | A1 | 5/2023 | Dixon et al. |
| 2023/0148762 | A1 | 5/2023 | Karschnik et al. |
| 2023/0181104 | A1 | 6/2023 | Johnston et al. |
| 2023/0190199 | A1 | 6/2023 | Molina |
| 2023/0210256 | A1 | 7/2023 | MacLachlan et al. |
| 2023/0210268 | A1 | 7/2023 | Kirk et al. |
| 2023/0210274 | A1 | 7/2023 | Hill et al. |
| 2023/0210275 | A1 | 7/2023 | Hill et al. |
| 2023/0218093 | A1 | 7/2023 | Nunn et al. |
| 2023/0255843 | A1 | 8/2023 | Sayadi et al. |
| 2023/0363963 | A1 | 11/2023 | Sayadi et al. |
| 2023/0380756 | A1 | 11/2023 | Palashewski et al. |
| 2023/0404282 | A1 | 12/2023 | Sayadi et al. |
| 2023/0404825 | A1 | 12/2023 | Stusynski et al. |
| 2023/0412683 | A1 | 12/2023 | Demirli et al. |
| 2024/0016302 | A1 | 1/2024 | Brosnan et al. |
| 2024/0032705 | A1 | 2/2024 | Nunn et al. |
| 2024/0041221 | A1 | 2/2024 | Blomseth et al. |
| 2024/0041677 | A1 | 2/2024 | Grey et al. |
| 2024/0091487 | A1 | 3/2024 | Molina et al. |
| 2024/0138579 | A1 | 5/2024 | Karschnik et al. |
| 2024/0156279 | A1 | 5/2024 | Nunn et al. |
| 2024/0164533 | A1 | 5/2024 | Johnston et al. |
| 2024/0172878 | A1 | 5/2024 | Palashewski et al. |
| 2024/0215735 | A1 | 7/2024 | Palashewski et al. |

FOREIGN PATENT DOCUMENTS

| | | |
|---|---|---|
| JP | 2008/264020 | 11/2008 |
| KR | 20090010582 | 1/2009 |
| TW | M519922 | 4/2016 |
| WO | WO 2021/146421 | 7/2021 |

OTHER PUBLICATIONS

U.S. Appl. No. 17/745,508, Nunn et al., filed May 16, 2022.
U.S. Appl. No. 18/433,289, Demirli et al., filed Feb. 5, 2024.
U.S. Appl. No. 18/602,407, Holmvik et al., filed Mar. 12, 2024.
U.S. Appl. No. 18/604,949, Palashewski et al., filed Mar. 14, 2024.
U.S. Appl. No. 18/639,292, Mayandi et al., filed Apr. 18, 2024.
U.S. Appl. No. 18/643,648, Sohn et al., filed Apr. 23, 2024.
U.S. Appl. No. 18/680,960, Garcia Molina et al., filed May 31, 2024.
U.S. Appl. No. 18/749,089, Garcia Molina, filed Jun. 20, 2024.
U.S. Appl. No. 29/881,955, Stusynski et al., filed Jan. 9, 2023.
U.S. Appl. No. 29/910,800, Stusynski et al., filed Aug. 24, 2023.
U.S. Appl. No. 29/924,373, Dixon et al., filed Jan. 18, 2024.
Gittemeier, "Installing LED Tape Lighting on Bed Frame," Jan. 24, 2015, retrieved from URL<https://www.youtube.com/watch?v=6yqDttlYXuY&ab_channel=KevinGittemeier>, 2 pages.
International Preliminary Report on Patentability in International Appln. No. PCT/US2022/053683, mailed on Jul. 11, 2024, 9 pages.

(56) References Cited

OTHER PUBLICATIONS

International Search Report and Written Opinion in International Appln. No. PCT/US2022/053683, mailed on Jun. 5, 2023, 16 pages.
Kelly Concepts, "How to Build a Modern Headboard |DIY| LED," Sep. 18, 2020, retrieved from URL<https://www.youtube.com/watch?v=hOPByL5X6jc&ab_channel-KellyConcepts>, 3 pages.

HEADBOARD WITH BACK LIGHT STRIP

INCORPORATION BY REFERENCE

This application is a Continuation of U.S. application Ser. No. 18/086,104, filed on Dec. 21, 2022, which claims priority to U.S. Provisional Application Ser. No. 63/295,221, filed on Dec. 30, 2021, the disclosure of which is incorporated by reference in its entirety.

TECHNICAL FIELD

This document describes devices, systems, and methods generally related to a bed system with back-facing lights providing ambient and circadian lighting in a sleep environment.

BACKGROUND

In general, a bed is a piece of furniture used as a location to sleep or relax. Many modern beds include a soft mattress on a bed frame. The mattress may include springs, foam material, and/or an air chamber to support the weight of one or more occupants.

SUMMARY

The document generally relates to a bed system having back-facing lights that provide ambient and circadian lighting in a sleep environment. More specifically, a headboard of the bed system can include lights inset in a back portion (e.g., back side) of the headboard. The lights can be backward facing, such that the lights cast light that reflects off a wall or other surface behind the headboard. As a result, the back portion of the headboard can be used to create a reflection of light on the wall to provide ambient lighting and circadian lighting for wake and/or sleep routines of users of the bed system.

The lights can be recessed in the back portion of the headboard. For example, the lights can be placed inside an extruded channel that is integrated into the back portion of the headboard. The extruded channel can include a plastic panel that covers the lights to diffuse the emitted light. The entire channel can be set into the back portion of the headboard and flush against the back portion of the headboard so that the headboard can be placed close and/or up against the wall.

The lights can be arranged around some or all of a perimeter of the back portion of the headboard. For example, the lights can be arranged in strips an equal distance inset from each side, top, and bottom of the back portion of the headboard. In other words, a strip of lights can extend vertically from the top to the bottom of the back portion of the headboard at a distance inset from a left side of the back portion of the headboard. Another strip of lights can extend vertically from the top to the bottom of the back portion of the headboard at an equal distance inset from a right side of the back portion of the headboard. Yet another strip of lights can extend horizontally from the left to the right side of the back portion of the headboard at an equal distance inset from the top of the back portion of the headboard. Yet another strip of lights can extend horizontally from the left to the right side of the back portion of the headboard at an equal distance inset from the bottom of the back portion of the headboard. All the above mentioned light strips can be connected to each other to create a seamless geometric shape of lights, such as a square or rectangle. One or more additional or fewer lights can be used. The lights can be arranged in a variety of other configurations in the back portion of the headboard in order to provide ambient and circadian lighting for users of the bed system.

The lights can be controlled by a controller of the bed system to provide ambient lighting and circadian lighting for the users of the bed system. For example, the controller can drive the lights to emit warm lighting in the evening as a sleep routine to help the user(s) prepare for restful sleep. The controller can also drive the lights to emit cooler and/or brighter lighting in the morning as part of a wake routine to help the user(s) wake up feeling refreshed.

One or more embodiments described herein can include a bed system including a headboard, backward facing lights positioned at a back side of the headboard, and a controller operably connected to the backward facing lights and configured to drive the backward facing lights to provide circadian lighting.

In some implementations, the embodiments described herein can optionally include one or more of the following features. For example, the backward facing lights can be recessed into the back side of the headboard. The bed system can also include a mattress positioned at a front side of the headboard. The bed system can include a foundation operably connected to the headboard. The backward facing lights can be inset into the back side of the headboard by 25 mm to 250 mm. The backward facing lights can be recessed into the back side of the headboard by 0 mm to 50 mm. The backward facing lights can provide ambient lighting when controlled by the controller.

As another example, the controller can determine when a user of the bed system is waking up based on sensed data and control the backward facing lights to provide circadian lighting that corresponds to a wakeup routine for the user. The circadian lighting that corresponds to the wakeup routine for the user can be brighter, stronger, and cooler shades of light than circadian lighting that corresponds to a sleep routine for the user. The controller can also determine when the user of the bed system is going to sleep based on sensed data and control the backward facing lights to provide circadian lighting that corresponds to a sleep routine for the user. The circadian lighting that corresponds to the sleep routine for the user can be less bright, less strong, and warmer shades of light than circadian lighting that corresponds to a wakeup routine for the user. Moreover, the backward facing lights can provide lighting that reflects off a wall opposite the back side of the headboard at an angle within a range of 96 degrees to 120 degrees.

In some implementations, at least one of the backward facing lights can extend a length proportionate to a size of the headboard across the back side of the headboard and a distance within a range of 25 mm to 250 mm from a top portion of the back side of the headboard. At least one of the backward facing lights can also extend a length proportionate to the size of the headboard and the distance within the range of 25 mm to 250 mm from a bottom portion of the back side of the headboard. At least one of the backward facing lights can extend a length proportionate to the size of the headboard from the top portion to the bottom portion of the back side of the headboard and the distance within the range of 25 mm to 250 mm from a left portion of the back side of the headboard. At least one of the backward facing lights can extend a length proportionate to the size of the headboard from the top portion to the bottom portion of the back side of the headboard and the distance within the range of 25 mm to 250 mm from a right portion of the back side of the headboard.

Moreover, the backward facing lights can be LED strips. The backward facing lights can be positioned inside an extruded channel in the back side of the headboard. The extruded channel can include a plastic panel that covers the backward facing lights when the backward facing lights are positioned inside the extruded channel. The plastic panel can be configured to diffuse the circadian lighting that is emitted by the backward facing lights. The extruded channel can be flush with the back side of the headboard.

As another example, the circadian lighting can match human circadian rhythm such that the circadian lighting can be brighter and stronger when a user wakes up than when the user falls asleep. In some implementations, (i) a left portion of the back side of the headboard can be angled towards a right side of the headboard and a midpoint of the back side of the headboard and (ii) a right portion of the back side of the headboard can be angled towards a left side of the headboard and the midpoint of the back side of the headboard. A top portion of the headboard can be wider than a bottom portion of the headboard such that the headboard can be maintained in a substantially straight plane and can be tilted downwards towards a ground on which the bed system rests. In some implementations, a top portion of the headboard can be narrower than a bottom portion of the headboard such that the headboard can be maintained in a substantially straight plane and can be tilted upward towards a ceiling. In some implementations, a top portion of the headboard can be substantially a same width as a bottom portion of the headboard.

One or more embodiments described herein can include a bed system including a headboard and a backward facing light. The backward facing light can be recessed into a back side of the headboard.

The embodiments described herein can optionally include one or more of the following features. For example, the bed system can include a controller operably connected to the backward facing light and configured to drive the backward facing light to provide circadian lighting. The backward facing lights can provide ambient lighting when controlled by the controller. The controller can determine when a user of the bed system is waking up based on sensed data and can control the backward facing lights to provide circadian lighting that corresponds to a wakeup routine for the user. The controller can also determine when the user of the bed system is going to sleep based on sensed data and can control the backward facing lights to provide circadian lighting that corresponds to a sleep routine for the user. The backward facing light can be an LED strip. The backward facing light can be positioned inside an extruded channel in the back side of the headboard. The extruded channel can include a plastic panel that covers the backward facing light when the backward facing light is positioned inside the extruded channel. The plastic panel can be configured to diffuse lighting that is emitted by the backward facing light. The extruded channel can be flush with the back side of the headboard.

The devices, system, and techniques described herein may provide one or more of the following advantages. For example, the back-facing lights are nonintrusive. The headboard can be pushed up against a wall or other surface in the sleep environment. The users of the bed system may not have to alter their layout or placement of furniture in the sleep environment.

Since the lights can be nonintrusive, the lights can improve aesthetic appeal of the bed system in the sleep environment. After all, the lights may partially or entirely hidden from the user's view in normal operation, even though they can provide sufficient ambient and circadian lighting to benefit sleep quality and/or sleep experience of the users of the bed system. Moreover, since the lights cast reflections off the wall using the back portion of the headboard, the lights can create diffused ambient lighting that can be easy and/or comforting on the human eye.

As another example, providing ambient lighting and circadian lighting using the disclosed techniques can support the user's circadian rhythm, thereby improving the user's overall sleep quality and/or sleep experience. The disclosed techniques can provide lighting that promotes relaxation for sleep routines and alertness for wake routines. For example, an amber glow around the user's bedtime can help the user's body prepare for more restful sleep and an improve sleep experience while a dawn simulation with brighter, light that is bluer and/or whiter in the morning can promote wakefulness and help the user wake up feeling more refreshed.

Moreover, the headboard can be secure and durable, engineered using high quality textiles, fine hardwoods, durable leather, and other materials that make the headboard sturdy. The headboard may also have accented tailoring and layering of materials to provide an aesthetically pleasing appearance.

Furthermore, while designed to support sleep needs for users of any age, the disclosed features and techniques of the bed system can also satisfy needs of a discrete aging population. Thus, the disclosed techniques can provide unique and dynamic abilities to adapt to any user of the bed system, no matter their needs.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to a bed system having backward facing lights to provide ambient lighting and circadian lighting in a sleep environment. The bed system can include a headboard having recessed lights in a back portion of the headboard. The lights can emit lighting that reflects off the back portion of the headboard and/or a wall behind the headboard. The lighting can be adjusted, by a controller of the bed system, based on whether users of the bed system are going to sleep or waking up. This is beneficial to support the users' circadian rhythms, promote relaxation when the users are going to sleep, and promote alertness when the users are waking up. As a result, the users can experience improved sleep quality and sleep experiences.

Figure 1:
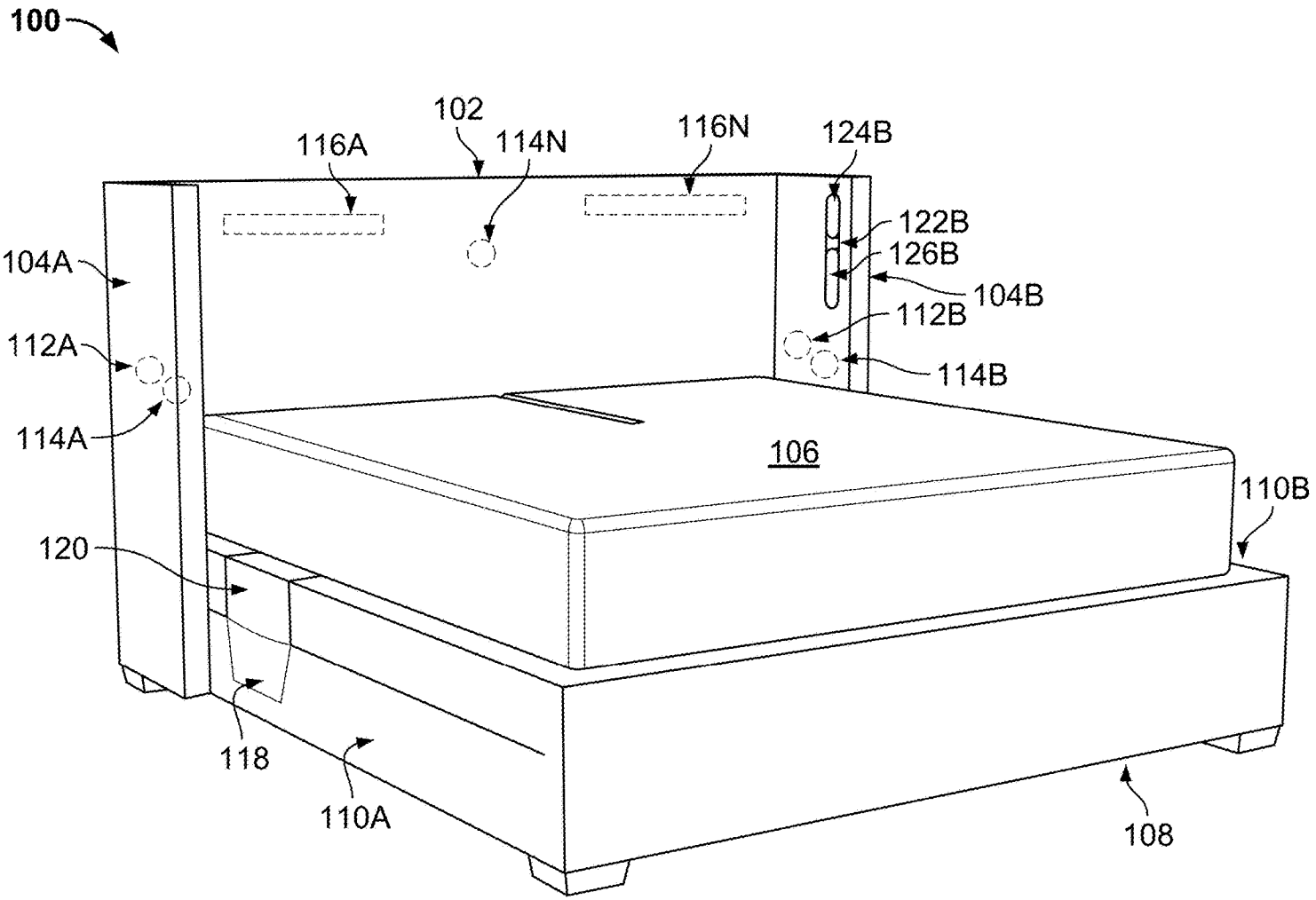
FIG. 1 depicts an example bed system.

Referring to the figures, FIG. 1 depicts an example bed system 100. The bed system 100 can include features that provide an improved sleep experience for a user of the bed system, including users having different age, conditions, demographics, and/or preferences.

The bed system 100 can include a headboard 102, foundation 108, and mattress 106. The mattress 106 can be sized for one user, such as a twin mattress. The mattress 106 can also be sized for two users, such as a full, queen, king, and/or California king mattress. As illustrated in FIG. 1, the mattress 106 can be a king mattress having a split top portion and a joined bottom portion. The mattress 106 can be an air mattress or other suitable mattress. The mattress 106 can also be articulable or stationary.

The headboard 102 can include a main headboard portion 201 and wings 104A and 104B. The wings 104A and 104B can extend a length along lateral edges of the mattress 106. In some implementations, the length can be 5 to 20 inches. In some implementations, the length can be 13 inches. For example, the wings 104A and 104B can extend to a length along the lateral edges of the mattress 106 that includes a head portion of the mattress 106 where the user may place their head on a pillow. As a result, the wings 104A and 104B can act as a barrier to some noises that may exist in a surrounding sleep environment.

The headboard 102 can include features for improving sleep experiences of the user of the bed system 100. For example, the headboard 102 can include speakers 112A and 112B, microphones 114A-N, lights 116A-N, docks 122A and 122B, reading lights 124A and 124B, and remotes 126A and 126B. The speakers 112A and 112B can be integrated into the wings 104A and 104B, respectively. The speakers 112A and 112B can be configured to play white and/or pink noise to reduce and/or cancel noise in the surrounding sleep environment. The user can connect one or more user devices (e.g. mobile phone, tablet, PC, or other computer) or another audio input to the speakers 112A and 112B (e.g., Bluetooth connection) to control audio that is played through the speakers 112A and 112B.

The microphones 114A and 114B can be integrated into the wings 104A and 104B, respectively. Additional microphones can also be integrated into other portions of the bed system 100. For example, the microphone 114N can be integrated into a midpoint of the headboard 102. Additional microphones can be integrated into the headboard 102 for each respective user/side of the mattress 106. The microphones 114A-N can be configured to detect noise in the surrounding sleep environment (such as snore or breathing sounds of one or both users, external noises, etc.). Based on the detected noise, the bed system 100 (e.g., a bed controller, such as controller 500 in FIG. 5) can generate an inverse sound wave to play through the speakers 112A and 112B to reduce and/or cancel the detected noise. As a result, the user of the bed system 100 can experience improved sleep quality undisturbed by noises in the surrounding sleep environment (e.g., snore or breathing sounds of one or both users, external noises, etc.).

The lights 116A-N can be integrated into a back portion of the headboard 102. The lights 116A-N, for example, can be recessed into the back portion of the headboard 102 and configured to provide ambient lighting that supports the user's circadian rhythm with wake and sleep routines.

The docks 122A and 122B can be integrated into the wings 104A and 104B, respectively. The docks 122A and 112B can house components such as the reading lights 124A and 124B, respectively, and the remotes 126A and 126B, respectively. These components can be kept in easy to access locations. In some embodiments, the user of the bed system 100 can access either of the reading lights 124A and 124B and/or the remotes 126A and 126B regardless of whether the user is laying down, sitting up, or otherwise inclined on the mattress 106. The reading lights 124A and 124B can extend out from the respective docks 122A and 122B and be tilted in a desired direction of the user. The user can also adjust the reading lights 124A and 124B color and intensity based on their particular needs and preferences. The remotes 126A and 126B can be used by the user to adjust their respective side of the bed system 100. For example, the remotes 126A and 126B can be used to adjust audio (e.g., volume level, turning audio on or off, setting a timer to automatically turn off the audio, etc.) that is played through the speakers 112A and 112B.

The foundation 108 includes side rails 110A and 110B. Pockets 118A and 118B (pocket 118B is not depicted in FIG. 1) can be integrated into the side rails 110A and 110B, respectively. The pockets 118A and 118B can be storage pockets for holding objects including but not limited to mobile devices (e.g., laptops, tablets, mobile phones, smart phones, etc.), books, magazines, and other items. The pockets 118A and 118B can include integrated inductive charging capabilities to charge one or more of the mobile devices placed therein. The pockets 118A and 118B can also include charging ports to provide wired charging of the mobile devices. The charging ports can include USB and USC ports. The pockets 118A and 118B can be integrated into portions of the side rails 110A and 110B that are easy to reach by the user of the bed system 100, regardless of whether the user is laying down, sitting up, or inclined to another position on the mattress 106.

Moreover, plates 120A and 120B (plate 120B is not depicted in FIG. 1) can be removably attached to a portion of the side rails 110A and 110B, respectively, that is aligned with and above the pockets 118A and 118B, respectively. The plates 120A and 120B can cover holes that are integrated into the side rails 110A and 110B and configured to receive and support side rail accessories. The side rail accessories (not shown in FIG. 1) can include tabletops and handrails, which can improve functionality of the bed system 100 and assist the user of the bed system 100 to get in and out of bed. The plates 120A and 120B can provide an aesthetically pleasing appearance of the foundation 108 when side rail accessories are not attached to the side rails 110A and 110B. When the side rail accessories are attached to either of the side rails 110A and 110B, the corresponding plate 120A or 120B can be removed so that the holes are exposed to receive supports of the side rail accessories.

Figure 2:
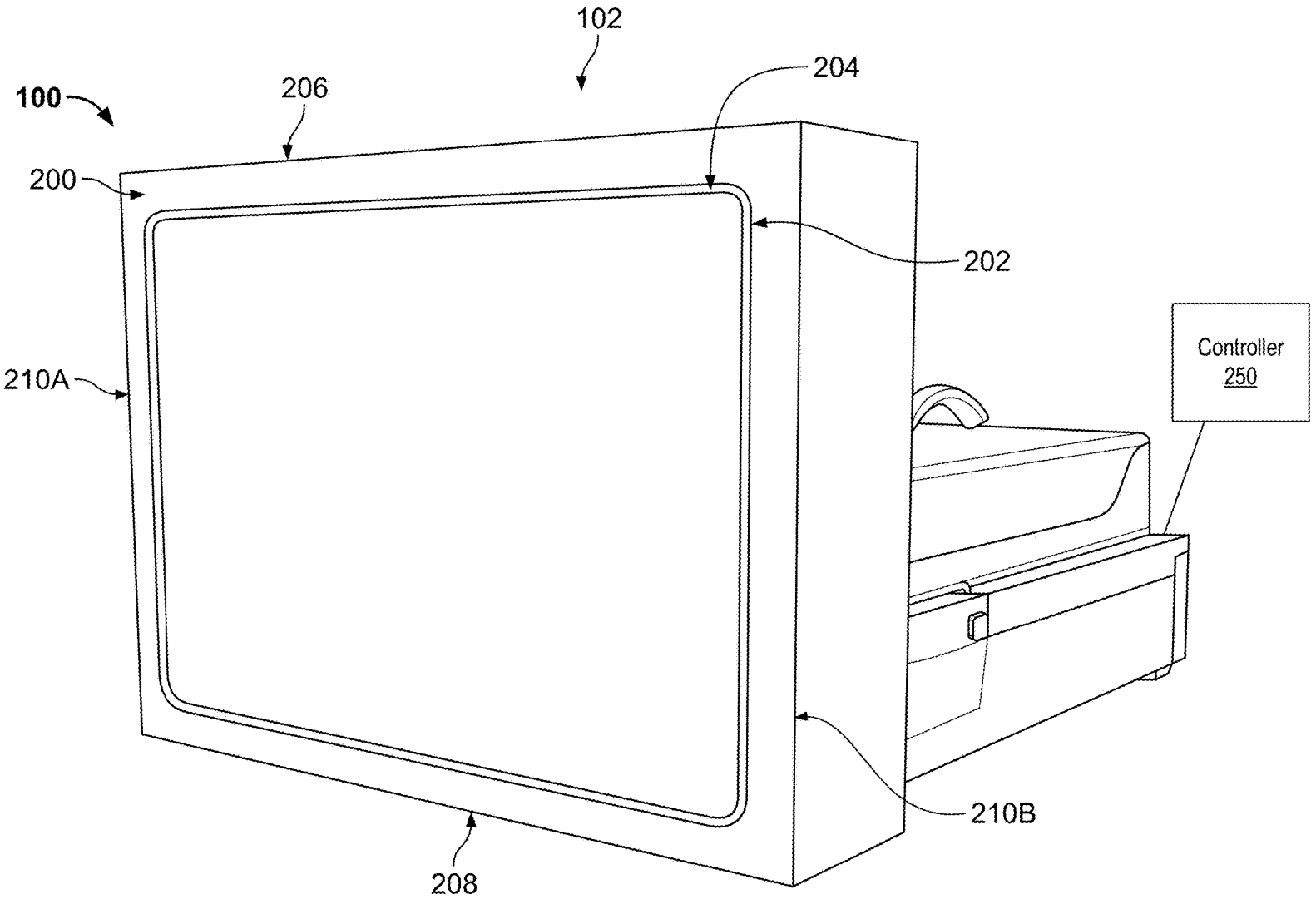
FIG. 2 depicts an example headboard of the bed system having recessed backward facing lights.

FIG. 2 depicts an example headboard 102 of the bed system 100 having recessed backward facing lights 204. The lights 204 can be the same as the lights 116A-N described in FIG. 1. The lights 204 can be LED strips. In some implementations, the lights 204 can be incandescent lights. The lights 204 can be positioned at a back portion 200 (e.g., back side) of the headboard 102. The lights 204 can be placed inside an extruded channel 202. The extruded channel 202 can be inset or otherwise integrated into the back portion 200 of the headboard 102. Accordingly, the lights 204 can be recessed into the back portion 200 of the headboard 102 within a range of approximately 0-50 mm. Moreover, the lights 204 can be inset from a top, bottom, left, and right edges of the back portion 200 of the headboard 102 within a range of approximately 25-250 mm. Additionally, a length of the LED strips (e.g., the lights 204) can be proportionate to a size of the headboard 102.

For example, the lights 204 can be arranged around a perimeter of the back portion 200 of the headboard 102 at equal distances from a first side 210A, a second side 210B, a top 206, and a bottom 208 of the back portion 200 of the headboard 102. The lights 204 can extend vertically from the top 206 to the bottom 208 of the back portion 200 of the headboard 102 at a distance inset from the first side 210A of the back portion 200 of the headboard 102. The lights 204 can also extend vertically from the top 206 to the bottom 208 of the back portion 200 of the headboard 102 at an equal distance inset from the second side 210B of the back portion 200 of the headboard 102. The lights 204 can further extend horizontally from the first side 210A to the second side 210B of the back portion 200 of the headboard 102 at an equal distance inset from the top 206 of the back portion 200 of the headboard 102. Moreover, the lights 204 can extend horizontally from the first side 210A to the second side 210B of the back portion 200 of the headboard 102 at an equal distance inset from the bottom 208 of the back portion 200 of the headboard 102.

The lights 204 can be connected to create a seamless geometric shape of lights, such as a square or rectangle, on the back portion 200 of the headboard 102. One or more additional or fewer lights can be used. The lights 204 can also be arranged in a variety of other configurations in the back portion 200 of the headboard 102 in order to provide ambient and circadian lighting for users of the bed system 100.

The bed system 100 can further include a controller 250. The controller 250 can include one or more processors and memory and can be configured to control actuation of various components of the bed system 100. For example, the controller 250 can be operably connected to the backward facing lights 204 and configured to drive the backward facing lights 204 to provide circadian lighting and ambient lighting. For example, the user of the bed system 100 can control the backward facing lights 204 from their user device (e.g., mobile device, mobile phone, smart phone) and/or a remote control for the bed system 100. The user can provide input that, when transmitted to the controller 250, causes the controller 250 to turn the backward facing lights 204 on or off, set and start a timer for how long the backward facing lights 204 remain on, and toggle between different presents for the backward facing lights 204. A first preset can be for morning lighting, in which the backward facing lights 204 can output 6,500K at 1,200 lumens. A second present can be for evening lighting, in which the backward facing lights 204 can output 2,700K at 600 lumens. One or more other presets can also be generated and used to control/adjust the backward facing lights 204.

In some implementations, the controller 250 can determine when the user of the bed system 100 is waking up based on sensed data from the bed system 100. Using the sensed data, the controller 250 can control the lights 204 to provide circadian lighting that corresponds to a wakeup routine for the user (e.g., such as the first preset mentioned above). The circadian lighting that corresponds to the wakeup routine for the user can be brighter, stronger, and cooler shades of light than circadian lighting that corresponds to a sleep routine for the user. The controller 250 can be integral to the bed system 100, can be positioned remote from the bed system 100, or both. In some embodiments, the controller 250 can control one or more other systems, such as an actuation system, an inflation system, and/or a climate control system.

Therefore, in some implementations, the controller 250 can determine when the user of the bed system is going to sleep based on sensed data from the bed system (using one or more sensors, not shown) and then control the backward facing lights 204 to provide circadian lighting that corresponds to a sleep routine for the user (e.g., such as the second preset mentioned above). The circadian lighting that corresponds to the sleep routine for the user can be less bright, less strong, and warmer shades of light than circadian lighting that corresponds to the wakeup routine for the user. Therefore, the circadian lighting can be provided to match a circadian rhythm of the user or users of the bed system 100 so that the circadian lighting is brighter and stronger when the user or users wake up than when the user or users fall asleep. As described throughout this disclosure, providing circadian lighting can be advantageous to promote improved sleep quality and sleep experiences of the user or users of the bed system 100.

Although the extruded channel 202 is depicted in FIG. 2 as being a continuous channel around a perimeter of the back portion 200 of the headboard 102, multiple extruded channels 202 can be integrated into the back portion 200 of the headboard 102 independent of each other. In other words, an extruded channel 202 can be integrated horizontally across the back portion 200 of the headboard 102 closer to the top 206 of the back portion 200 of the headboard 102 than the bottom 208 of the back portion 200 of the headboard 102. Another extruded channel 202 can be integrated horizontally across the back portion 200 of the headboard 102 closer to the bottom 208 of the back portion 200 of the headboard 102 than the top 206 of the back portion 200 of the headboard 102. Moreover, another extruded channel 202 can be integrated vertically down the back portion 200 of the headboard 102 closer to the first side 210A of the back portion 200 of the headboard 102 than the second side 210B of the back portion 200 of the headboard 102. Yet another extruded channel 202 can be integrated vertically down the back portion 200 of the headboard 102 closer to the second side 210B of the back portion 200 of the headboard 102 than the first side 210A of the back portion 200 of the headboard 102. In some embodiments, one, two, or more than four extruded channels 202 with lights 204 can be used.

Figure 3:
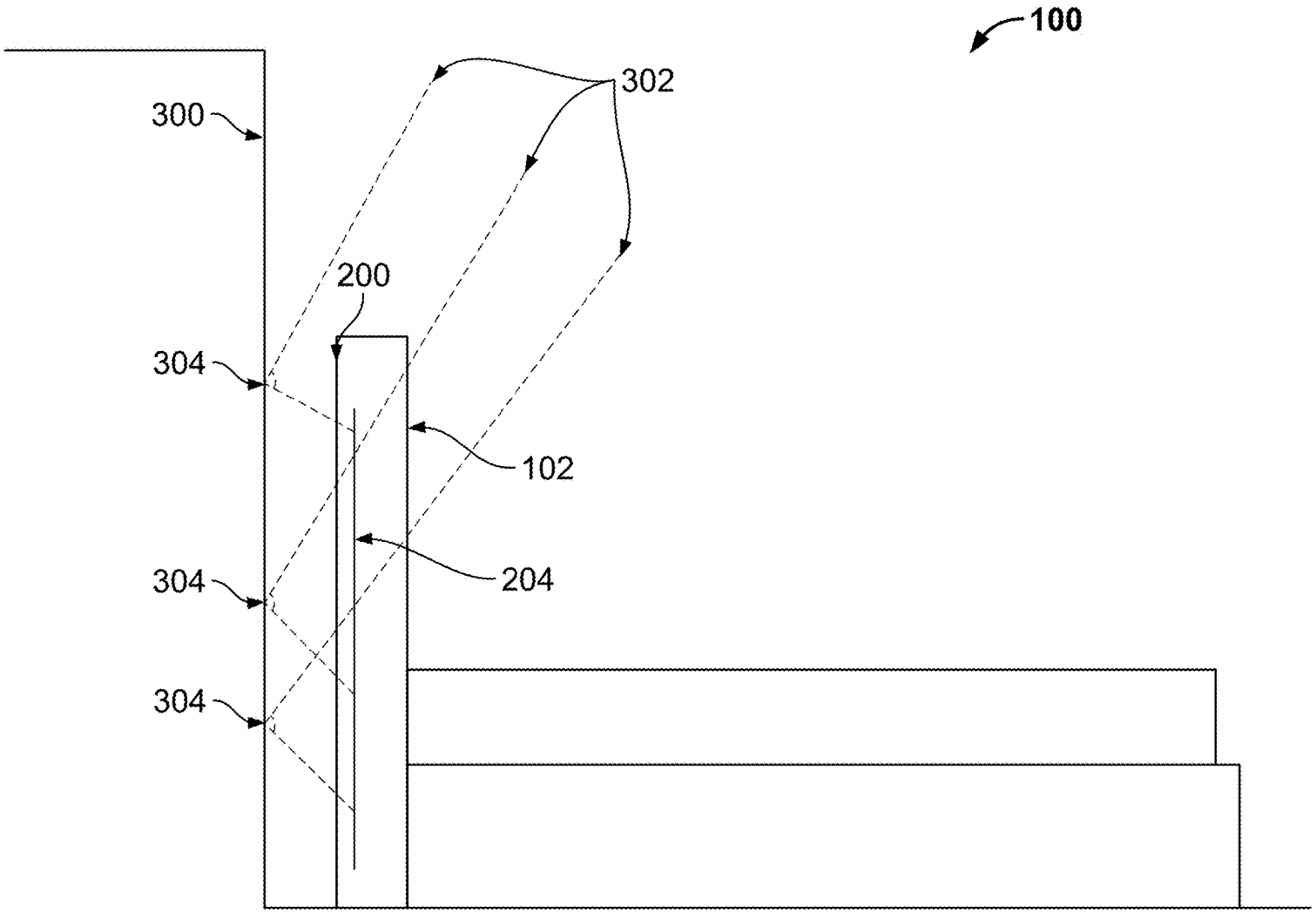
FIG. 3 depicts a side view of the bed system having the recessed backward facing lights.

FIG. 3 depicts a side view of the bed system 100 having the recessed backward facing lights 204. In the example of FIG. 3, the bed system 100 is pushed near but not entirely pushed up flush against a wall 300. Rather, the bed system 100 is some distance away from the wall 300. However, in some implementations, the bed system 100 can be pushed up (e.g., flush) against the wall and still provide a desired lighting effect according to the disclosed techniques. The lights 204 can provide lighting that reflects 302 off the wall 300 opposite the back portion 200 of the headboard 102. The lighting can reflect 302 off the wall 300 at an angle 304. The angle 304 can be within a range of approximately 90 to 160 degrees. In some implementations, the angle 304 can be within a range of 96 to 120 degrees.

Figure 4:
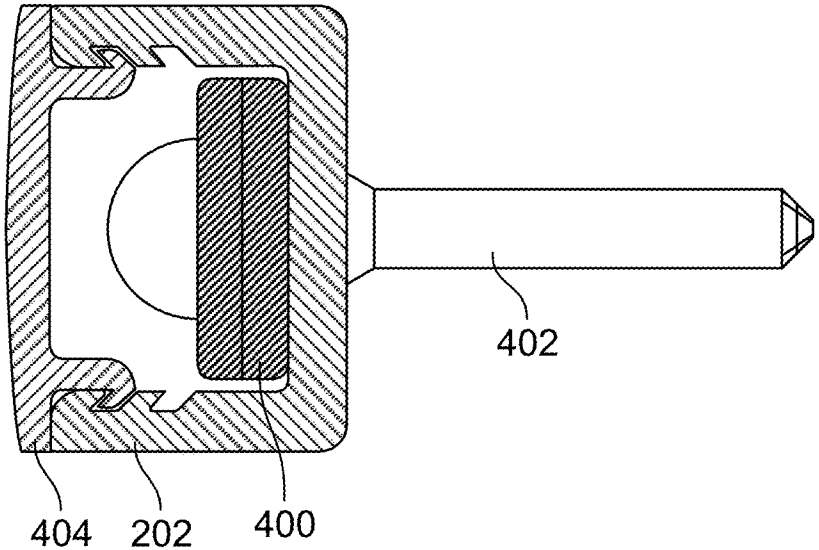
FIG. 4 depicts example components of the headboard for providing backward facing lighting.
Figure 4:
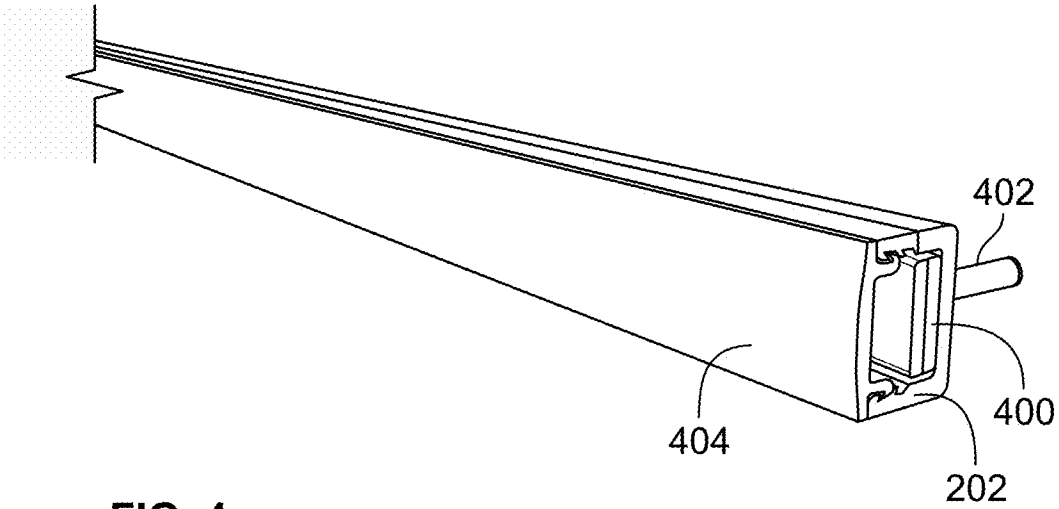

FIG. 4 depicts example components of the headboard 102 for providing backward facing lighting. As described above, an LED strip 400 can be positioned inside the extruded channel 202 in the back portion of the headboard (e.g., refer to FIGS. 2-3). The extruded channel 202 can further include a plastic panel 404 that covers the LED strip 400 when the LED strip 400 is positioned inside the extruded channel 202. The plastic panel 404 can be configured to diffuse ambient lighting and/or circadian lighting that is emitted by the LED strip 400. The extruded channel 202 can further include mounting screws 402 for attaching/integrating the extruded channel 202 with the headboard described throughout this disclosure such that the extruded channel 202 is flush with the back portion of the headboard. A mounting screw 402 can be placed at or near each end of the extruded channel 202. The mounting screws 402 can also be placed at other locations along a length of the extruded channel 202 so that the extruded channel 202 can remain securely attached and integrated with the headboard.

Figure 5:
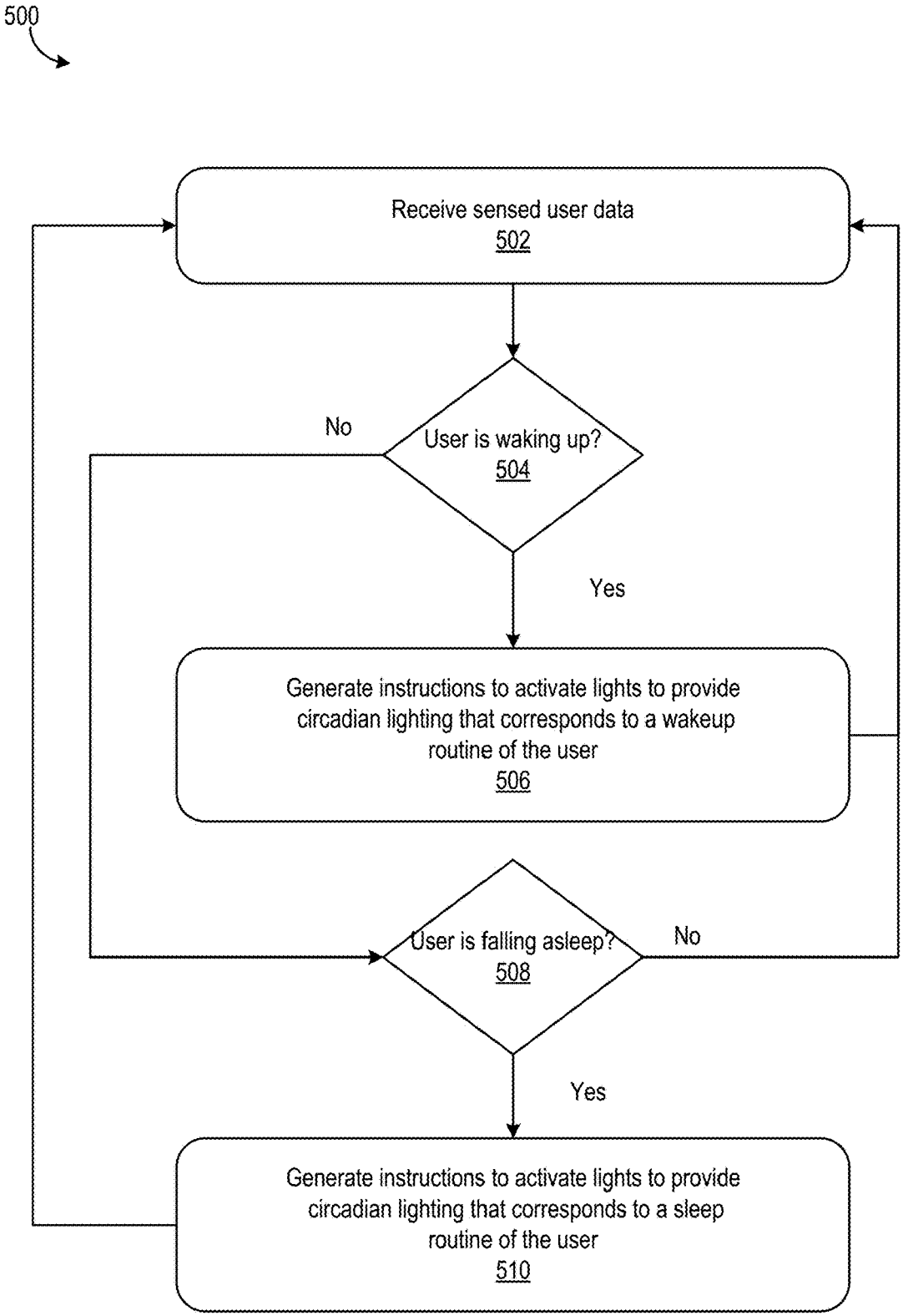
FIG. 5 is a flowchart of a process for activating circadian lighting at the bed system.

FIG. 5 is a flowchart of a process 500 for activating circadian lighting at the bed system. The process 500 can be performed by the controller 250 described in FIG. 2. The process 500 can also be performed by one or more other computing systems, devices, computers, networks, cloud-based systems, cloud-based services, and/or remote cloud-based control systems. For illustrative purposes, the process 500 is described from the perspective of a controller.

Referring to the process 500, the controller can receive sensed user data in block 502. The user data can be sensed by one or more sensors of the bed system. For example, the bed system can include pressure sensors connected to air chambers of an inflatable air mattress and/or pumps that provide air to the air chambers. The pressure sensors can detect changes in pressure that can be used by the controller to determine whether a user is present in the bed system and/or whether the user is falling asleep or waking up.

As another example, the microphones 114A-N shown in FIG. 1 can detect audio around the bed system. Audio detected by the microphones 114A-N can be received and processed by the controller to determine whether the user is present in the bed system and/or whether the user is falling asleep or waking up. In other examples, other sensors (e.g. temperature sensors, force sensors, etc.) can be used.

In block 504, the controller can determine whether the user of the bed system is waking up. Sometimes, the user can provide user input at a device, such as a user device or a remote control for the bed system, to control the lights. The user input can include selection of an option to activate the lights to provide circadian lighting that corresponds to a wakeup routine. The controller can determine that the user is awake based on receiving this user input. In some implementations, the controller can use the sensed user data to make this determination. For example, the controller can determine that the user is waking up based on an alarm time that can be set by the user. The controller can initiate the lights a few minutes (or some other predetermined amount of time) before the alarm is set to go off. The controller can also determine that the user is waking up using sleep sensing technology of the bed system.

If the user is determined to be waking up or is awake, then the controller can proceed to block 506. In block 506, the controller can generate instructions to activate lights (e.g., the lights 204) that can provide circadian lighting that corresponds to a wakeup routine of the user. In some implementations, the controller can generate instructions that activate the lights based on identifying a bedtime and wakeup schedule for the user. The instructions can also be generated based on historic sleep data about the user that can be retrieved from a data store. Instead of or in addition to the sensed user data, the controller can retrieve a wakeup schedule for the user from the data store. The wakeup schedule can indicate a time that the user typically wakes up. In block 506, the controller can then activate the lights at or around the time that the user typically wakes up (e.g., 20 minutes before the wakeup time, 10 minutes before the wakeup time, 5 minutes before the wakeup time, at the wakeup time, etc.), based on the wakeup schedule for the user.

The controller can then return to block 502 and repeat the process 500.

If the controller determines that the user is not waking up in block 504 (or that the user did not provide user input to control the lights), the controller can proceed to block 508. In block 508, the controller can determine whether the user is falling asleep. As mentioned above, the controller can determine whether the user is falling asleep based on whether the controller receives user input from the device, such as the user device or the remote control. The user input can include selection of an option to activate the lights to provide circadian lighting that corresponds to a sleep routine. This user input indicates that the user desires to go to sleep. In some implementations, the controller can use the sensed user data to make this determination.

If the user is not falling asleep (or did not provide user input to active the lights to provide circadian lighting that corresponds to a sleep routine), the controller can return to block 502 and continue to monitor the bed system and wait for user input as described in the process 500. If the user is falling asleep (or the user provided user input to activate the lights to provide circadian lighting that corresponds to a sleep routine), the controller can generate instructions to activate lights to provide circadian lighting that corresponds to the sleep routine of the user in block 510. In some implementations, the controller can generate instructions that activate the lights based on identifying the bedtime schedule for the user. For example, instead of or in addition to the sensed user data, the controller can retrieve a bedtime schedule for the user from the data store. The bedtime schedule can indicate a time that the user typically goes to sleep. In block 508, the controller can then activate the lights at or around the time that the user typically goes to sleep, based on the bedtime schedule for the user (e.g., 20 minutes before falling asleep, 10 minutes before, 5 minutes before, etc.). Moreover, in some implementations, the controller can turn on the lights around a time that the user is getting ready to go to sleep, which can help the user wind down and prepare for sleep. Using user sensing technology of the bed system, the bed system can determine when the user is relaxing for sleep, which can be used by the controller to turn off the lights.

The controller can then return to block 502 and repeat the process 500. In some implementations, the process 500 can stop after block 510. Sometimes, the process 500 can start again once a presence of the user is detected.

Figure 6A:
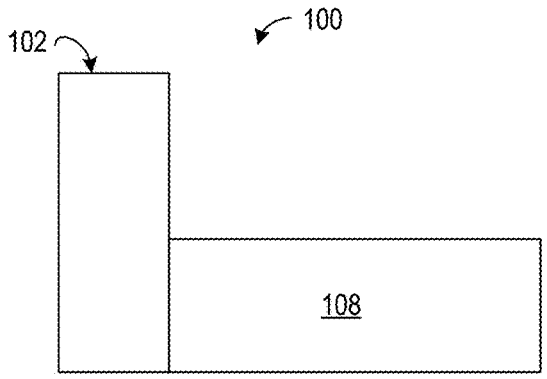
FIGS. 6A-D depict bed systems with example headboards having recessed backward facing lights.

FIGS. 6A-D depict bed systems with example headboards having recessed backward facing lights. FIG. 6A depicts a side view of the bed system 100 described throughout this disclosure, which includes the headboard 102 and the foundation 108. The design of the headboard 102 allows for a uniform glow of light from the recessed backward facing lights around the entire headboard 102.

Figure 6B:
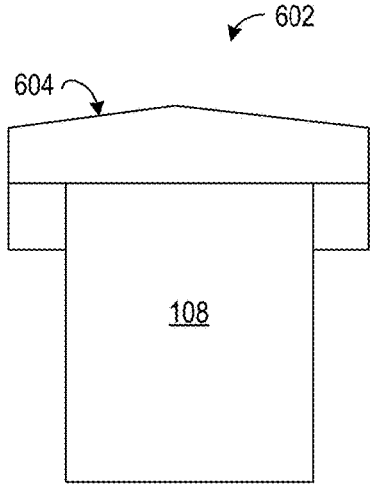

FIG. 6B depicts a top view of bed system 602 having an alternative design of headboard 604. The headboard 604 can include the recessed backward facing lights as described throughout this disclosure. Unlike the headboard 102, a left portion of a back side of the headboard 604 can be angled towards a midpoint of the back side of the headboard 604 (e.g., angled towards the right side of the headboard 604) and a right portion of the back side of the headboard 604 can also be angled towards the midpoint (e.g., angled towards the left side of the headboard 604). The design of the headboard 604 can be beneficial to provide improved glow from the recessed backward facing lights on the sides of the headboard 604.

Figure 6C:
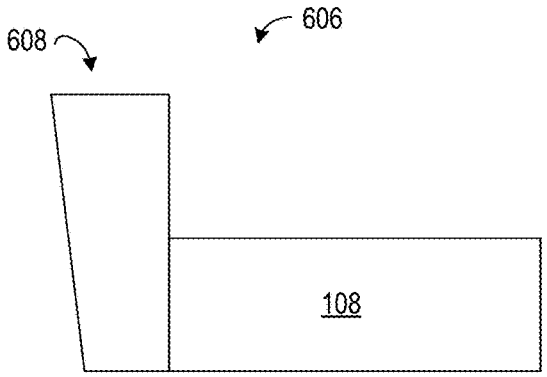

FIG. 6C depicts a side view of bed system 606 having headboard 608. The headboard 608 can include the recessed backward facing lights as described throughout this disclosure. Unlike the headboards 102 and 604, the headboard 608 can be wider at a top portion of the headboard 608 and narrower towards a bottom portion of the headboard 608 such that the headboard 608 is maintained in a substantially straight plane and is tilted downwards towards the ground. The design of the headboard 608 can be beneficial to provide improved glow from the recessed backward facing lights on the ground surrounding the bed system 606.

Figure 6D:
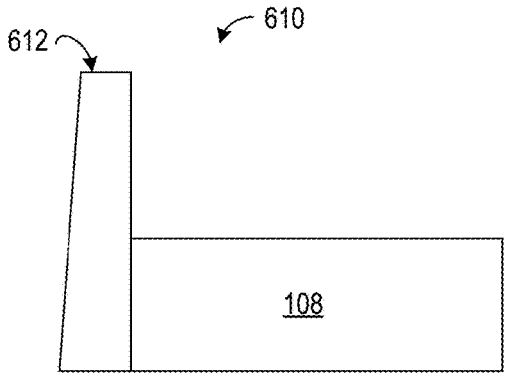

Moreover, FIG. 6D depicts a side view of bed system 610 having headboard 612. The headboard 612 can include the recessed backward facing lights as described throughout this disclosure. Unlike the headboards 102, 604, and 608, the headboard 612 can be wider at a bottom portion of the headboard 612 and narrower towards a top portion of the headboard 612 such that the headboard 612 is maintained in a substantially straight plane and is tilted up towards the ceiling. Therefore, the headboard 612 can be tilted at an inverse angle from the headboard 608. The design of the headboard 612 can be beneficial to provide improved glow from the recessed backward facing lights against a wall, above the top portion of the headboard 612, and towards the ceiling. The design of the headboard 612 can be beneficial to make the light from the recessed backward facing lights more visible to the user(s) while in the bed system 610.

While this specification contains many specific implementation details, these should not be construed as limitations on the scope of the disclosed technology or of what may be claimed, but rather as descriptions of features that may be specific to particular embodiments of particular disclosed technologies. For example, in some embodiments the headboards, lights, backward facing lights, channels, mattresses, or other features can be varied as suitable for the application. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A headboard for a bed comprising:

a front surface configured to face a mattress;

a first back surface configured to face away from the front surface, wherein the first back surface has a first outer perimeter;

a second back surface configured to face away from the front surface, wherein the second back surface has a second outer perimeter that is smaller than the first outer perimeter, wherein an elongate gap is defined between the first back surface and the second back surface; and a light strip positioned in the elongate gap between the first back surface and the second back surface.

2. The headboard of claim 1, further comprising an extruded channel positioned between the first back surface and the second back surface, wherein the extruded channel defines the elongate gap, wherein the light strip is positioned in the extruded channel.

3. The headboard of claim 2, further comprising a panel covering the extruded channel to enclose the light strip between the panel and the extruded channel.

4. The headboard of claim 3, further comprising a plurality of mounting screws extending from a bottom of the extruded channel, the plurality of mounting screws coupling the extruded channel to the headboard within the elongated gap.

5. The headboard of claim 4, wherein the plurality of mounting screws is integrally formed with the extruded channel.

6. The headboard of claim 5, wherein at least one mounting screw of the plurality of mounting screws are positioned at each end of the extruded channel.

7. The headboard of claim 6, wherein at least one mounting screw of the plurality of mounting screws are positioned between the ends of the extruded channel.

8. The headboard of claim 2, wherein the extruded channel is continuous around at least three sides of the second outer perimeter.

9. The headboard of claim 3, wherein the extruded channel comprises:

a top horizontal portion;

a bottom horizontal portion;

a first side portion extending between the top horizonal portion and the bottom horizontal portion; and a second side portion extending between the top horizonal portion and the bottom horizontal portion opposite the first side portion, wherein the top horizontal portion, the bottom horizontal portion, the first side portion, and the second side portion are coupled together to hold the light strip such that the light strip is positioned to transmit light uninterrupted from the elongated gap.

10. The headboard of claim 9, wherein the panel covers the top horizontal portion of the extruded channel.

11. The headboard of claim 9, wherein the panel is coupled to the extruded channel on inner surfaces of the first side portion and the second side portion.

12. The headboard of claim 3, wherein the panel is configured to snap into the extruded channel.

13. The headboard of claim 1, wherein the second outer perimeter is spaced from the first outer perimeter between 25 and 250 millimeters.

14. The headboard of claim 1, wherein the light strip is recessed in the elongate gap up to 50 millimeters.

15. The headboard of claim 1, wherein the light strip is configured to emit light from the elongated gap seamlessly.

16. The headboard of claim 1, wherein the light strip is positioned in the elongated gap such that light is emitted from the elongated gap such that, when reflated off a wall, the light reflates at an angle between 90 and 160 degrees relative to a plane defined by the wall.

17. The headboard of claim 1, wherein the light strip is recessed in the elongated gap such that light is emitted from the elongated gap such that, when reflated off a wall, the light reflates at an angle between 96 and 120 degrees relative to a plane defined by the wall.

18. The headboard of claim 1, wherein the light strip is oriented to create a seamless geometric shape of light emitting from the headboard.

19. The headboard of claim 1, wherein the light strip comprises a planar top surface oriented toward an opening of the elongated gap.

20. The headboard of claim 1, wherein the light strip comprises a hemispherical top surface oriented toward an opening of the elongated gap.

* * * * *